US006286547B1

(12) United States Patent
Dettmann

(10) Patent No.: US 6,286,547 B1
(45) Date of Patent: Sep. 11, 2001

(54) MODULE FOR DRIVING ACTUATORS

(75) Inventor: Heinrich Dettmann, Niedernhall (DE)

(73) Assignee: Burkert Werke GmbH & Co. (DE)

( * ) Notice: Subject to any disclaimer, the term of this patent is extended or adjusted under 35 U.S.C. 154(b) by 0 days.

(21) Appl. No.: 09/461,760

(22) Filed: Dec. 15, 1999

(30) Foreign Application Priority Data

Dec. 23, 1998 (DE) ..... 298 22 958 U

(51) Int. Cl.[7] ..... F15B 13/043
(52) U.S. Cl. ..... 137/596.15; 137/596.16
(58) Field of Search ..... 137/596.15, 196.16

(56) References Cited

U.S. PATENT DOCUMENTS

| | | | | |
|---|---|---|---|---|
| Re. 26,523 | * | 2/1969 | Tennis | 137/596.15 X |
| Re. 29,481 | * | 11/1977 | Larner | 137/596.15 |
| 2,569,881 | * | 10/1951 | Davies | 137/596.15 X |
| 2,891,518 | * | 6/1959 | Krapf | 137/596.15 X |
| 3,411,536 | * | 11/1968 | Tennis | 137/596.15 |
| 3,556,144 | | 1/1971 | Bickers et al. | 137/596.15 |
| 4,516,605 | * | 5/1985 | Taplin | 137/596.15 |
| 4,540,020 | * | 9/1985 | Taplin | 137/596.15 |
| 4,711,267 | * | 12/1987 | Schwelm | 137/596.15 |
| 4,765,370 | | 8/1988 | Ariizumi et al. . | |
| 5,711,346 | * | 1/1998 | Pieloth et al. | 137/625.44 |

FOREIGN PATENT DOCUMENTS

| | | | | |
|---|---|---|---|---|
| 2 147 439 | * | 4/1973 | (DE) | 137/596.15 |
| 36 30 200 A | | 3/1988 | (DE) . | |
| 3604410 A1 | | 8/1988 | (DE) . | |
| 195 02 212 C | | 7/1996 | (DE) . | |
| 1 249 404 A | | 3/1961 | (FR) . | |
| 58-180877 | * | 10/1983 | (JP) | 137/596.16 |
| 62-127583 | * | 6/1987 | (JP) | 137/596.16 |
| 62-209277 | * | 9/1987 | (JP) | 137/596.16 |

* cited by examiner

*Primary Examiner*—Gerald A. Michalsky
(74) *Attorney, Agent, or Firm*—Stuart J. Friedman; Nixon Peabody, LLP

(57) ABSTRACT

A module comprises a pilot valve and four switching valves, in particular for driving actuators, the pilot valve being a 4/3-way valve.

4 Claims, 10 Drawing Sheets

MODULE FOR DRIVING ACTUATORS

The invention relates to a module comprising a pilot valve and four switching valves, in particular for driving actuators.

BACKGROUND OF THE INVENTION

Such a module may form a 5/3- or 4/3- way valve and makes it possible to drive an actuator, for example, a double-acting hydraulic cylinder. The pilot valves are usually formed by sliding valves, more particularly two solenoid pilot valves. The slider assumes a center position when the pilot valves are not energized, whereas the slider assumes either a first or a second off-center switching position when one or the other pilot valve is driven. A similar or even higher piloting requirement is needed for corresponding diaphragm valves in 5/3- and 4/3- way arrangements. It is especially when these valves are used in in-line valve islands that high complexity results in wiring the solenoid contacts of the pilot valves to a control terminal.

The object of the invention is to simplify driving fluid-actuated 5/3- and 4/3- way valves such that all three switching positions of the valves may be switched by a single solenoid of a pilot valve.

BRIEF DESCRIPTION OF THE INVENTION

This object is achieved with a module comprising a pilot valve and four switching valves, in particular for driving actuators, the pilot valve being a 4/3- way valve. In this way the complication and bulk of the two solenoid pilot valves provided hitherto is reduced to that involved in a single pilot valve, thus facilitating the connection of the valves to valve islands and interlinking such valves to a common power/fluid supply.

Advantageous aspects of the invention read from the sub-claims.

BRIEF DESCRIPTION OF THE DRAWINGS

The invention will now be described with reference to various embodiments as shown in the attached drawings in which.

DETAILED DESCRIPTION OF THE INVENTION

Figure 1:
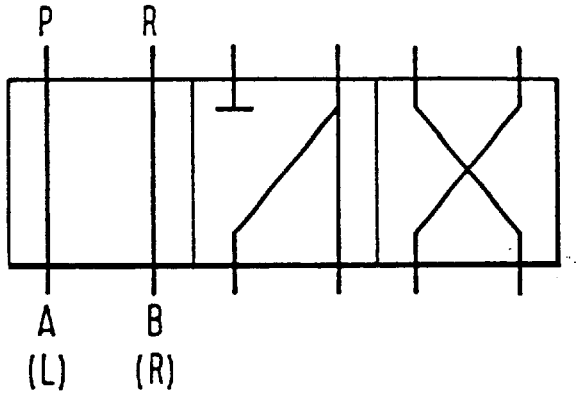
FIGS. 1*a*) to 1*d*) are schematic representations of an actuator in various circuit variants.
Figure 1:
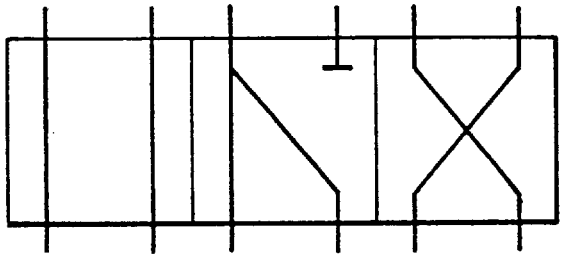
Figure 1:
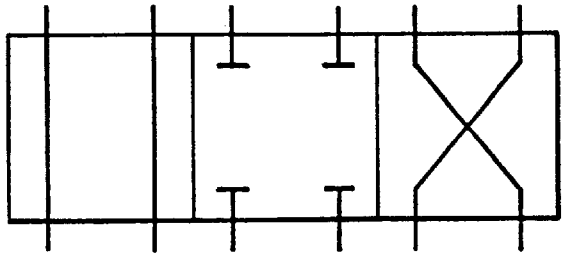
Figure 1:
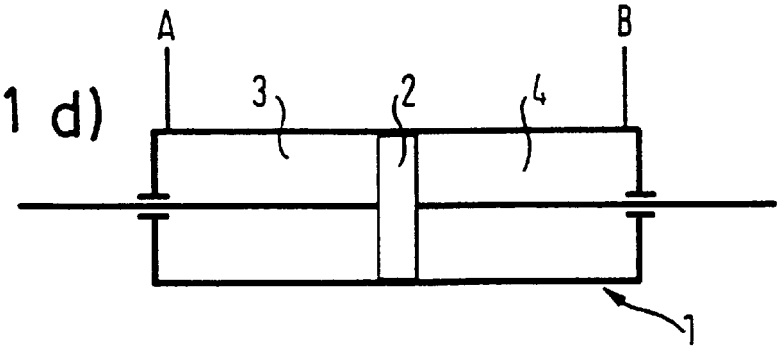

Referring now to FIG. 1*d* there is illustrated the driving of an actuator as will now be described in general, the actuator in this case shown as a double-acting actuator cylinder 1. The actuator cylinder 1 comprises a piston 2 as well as a working chamber 3 on the left-hand side of the piston 2 and a working chamber 4 on the right-hand side. The working chamber 3 is provided with a port A and the working chamber 4 is provided with a port B.

FIGS. 1*a* to 1*c* , show various kinds of driving the actuator cylinder, a 4/3- way valve being employed in each example. In each left-hand switching position the working chamber 3 is pressurized by a fluid at a pressure P, for example compressed air, whilst the right-hand working chamber 4 is connected to a port R serving as return conduit. The piston 2 is thus urged to the right. In each right-hand switching position the working chamber 4 is pressurized by the pressure P via port B, whilst the left-hand working chamber 3 is connected to the return conduit R. The piston 2 is thus urged to the left.

These three circuiting examples each differ as regards their center position. In the center position as shown in FIG. 1*a*) a floating circuit is achieved in which the two working chambers 3, 4 are connected to the return conduit R, i.e. the piston 2 being freely movable. The circuit example as shown in FIG. 1*b*) achieves in the center position a lockup position in which each of the two working chambers 3, 4 is pressurized by the pressure P, i.e. the piston 2 is blocked from moving at all. In the example as shown in FIG. 1*c*), a lockup position is likewise achieved, but in this case each of the two working chambers 3, 4 being shut off, i.e. closed. Here too, the piston 2 is blocked.

Figure 2:
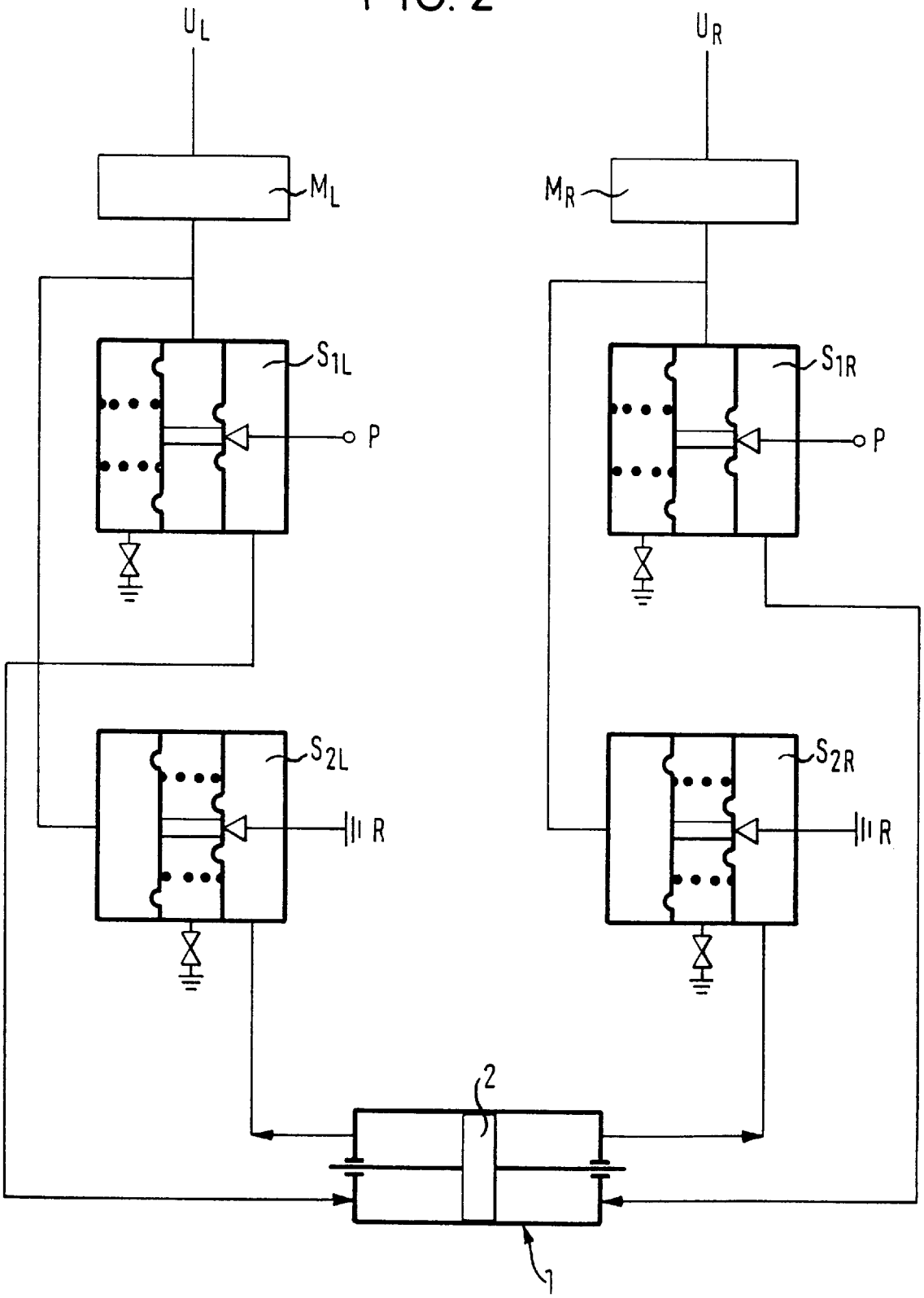
FIG. 2 is a schematic representation of a first circuit arrangement for an actuator.

Referring now to FIG. 2 there is described an example for driving an actuator cylinder, in this case solenoid valves M being used as the pilot valves connected to the switching valves $S_1$ and $S_2$. To indicate assignment to the left-hand or right-hand working chamber of the actuator, the solenoid valves and switching valves are indexed L and R, respectively.

An energizing voltage U may be applied to the solenoid valves. The switching valves are provided with a pressure port P and with a return port R.

Depending on how the solenoid valves M are driven, various driving modes are achievable for the actuator 1 with the circuit as shown in FIG. 2. These various possibilities are listed in the following Table 1:

TABLE 1

| | $U_L$ | $U_R$ | $S_{1L}$ | $S_{2L}$ | $S_{1R}$ | $S_{2R}$ | Operating Mode |
|---|---|---|---|---|---|---|---|
| 1 | 0 | 0 | $P_{closed}$ | $R_{open}$ | $P_{closed}$ | $R_{open}$ | Drive freely movable |
| 2 | L | 0 | $P_{open}$ | $R_{closed}$ | $P_{closed}$ | $R_{open}$ | Drive to the right |
| 3 | 0 | L | $P_{closed}$ | $R_{open}$ | $P_{open}$ | $R_{closed}$ | Drive to the left |
| 4 | L | L | $P_{open}$ | $R_{closed}$ | $P_{open}$ | $R_{closed}$ | Drive fixed |

In this table, P refers to a pressure port, whereas R refers to an unpressurized return port.

The switching conditions 1 to 3 as shown in the Table correspond to those of the circuit as shown in FIG. 1*a*), the switching conditions 2 to 4 correspond to those of the circuit as shown in FIG. 1*b*.

Figure 3:
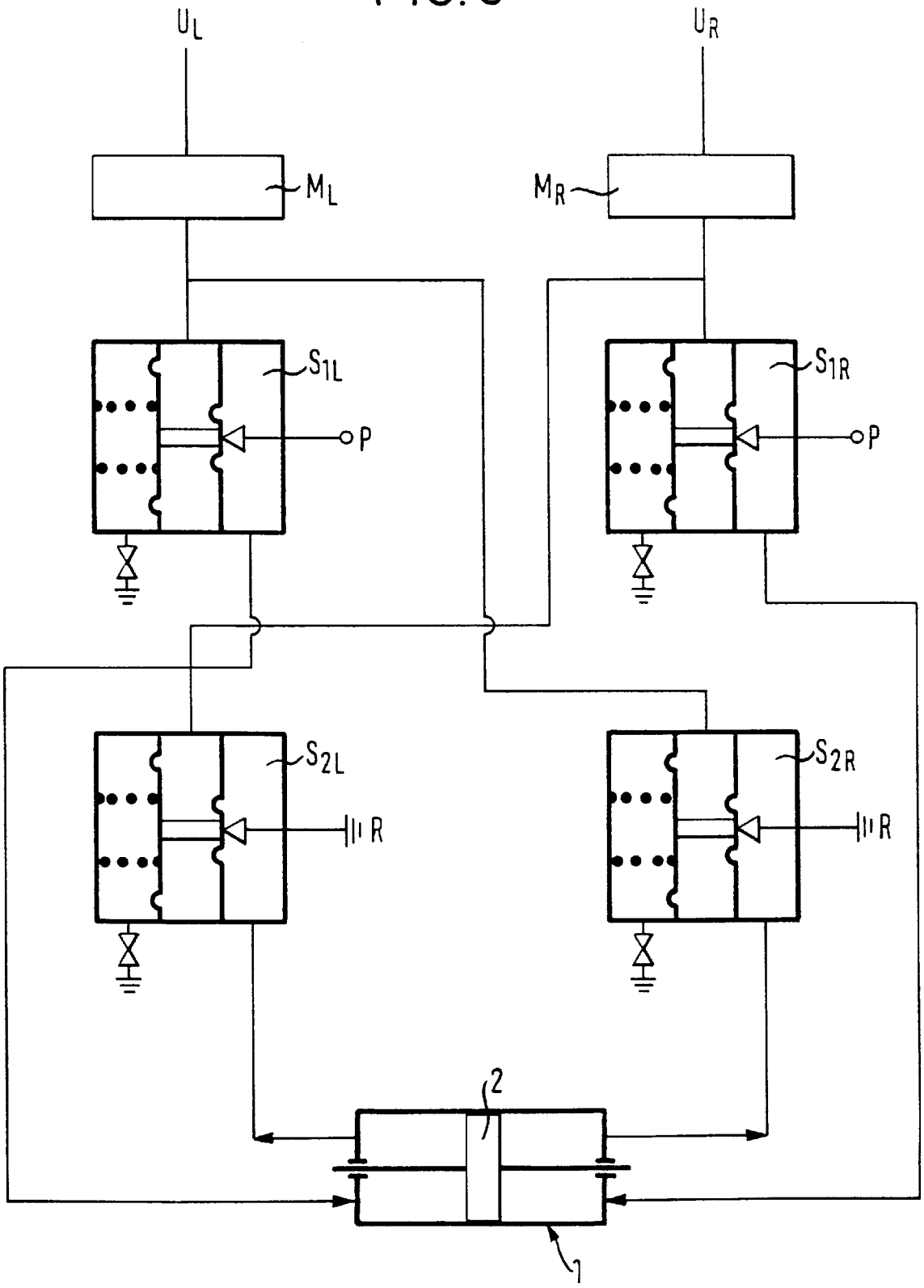
FIG. 3 is a schematic representation of a second circuit arrangement for an actuator.
Figure 4:
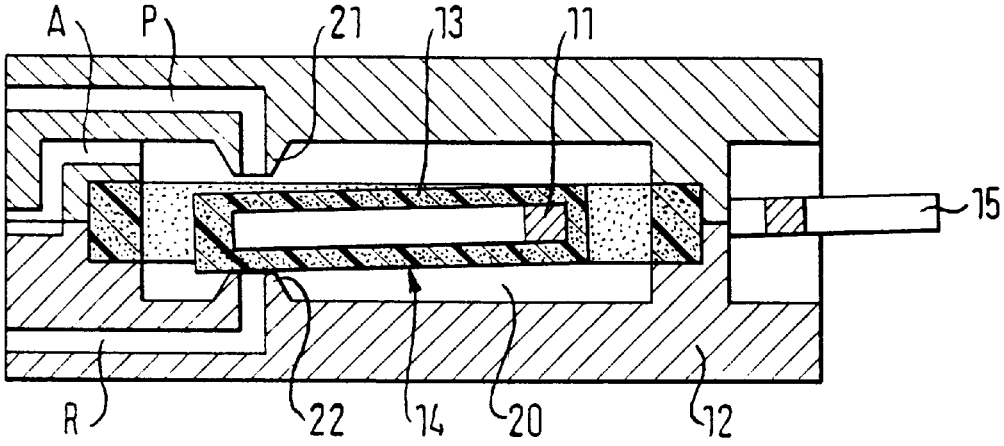
FIG. 4 is a schematic illustration of part of a housing of a pilot element including a control chamber and a sealing part arranged therein.
Figure 5:
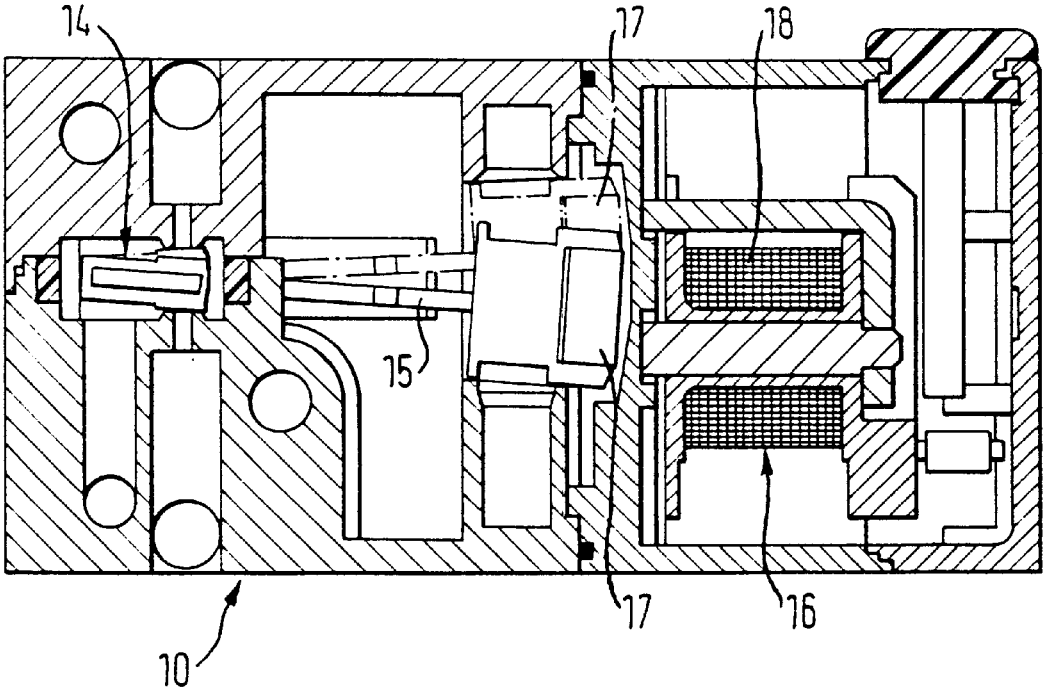
FIG. 5 is a schematic section view of a pilot element.

In FIG. 3 is shown another way of circuiting the actuator 1, the resulting drive modes of which are listed in the following Table 2:

TABLE 2

| | $U_L$ | $U_R$ | $S_{1L}$ | $S_{2L}$ | $S_{1R}$ | $S_{2R}$ | Drive Mode |
|---|---|---|---|---|---|---|---|
| 1 | 0 | 0 | $P_{closed}$ | $R_{closed}$ | $P_{closed}$ | $R_{closed}$ | Drive fixed |
| 2 | 0 | L | $P_{closed}$ | $R_{open}$ | $P_{open}$ | $R_{closed}$ | Drive to the left |
| 3 | L | 0 | $P_{open}$ | $R_{closed}$ | $P_{closed}$ | $R_{open}$ | Drive to the right |
| 4 | L | L | $P_{open}$ | $R_{open}$ | $P_{open}$ | $R_{open}$ | Drive fixed |

The switching conditions 1 to 3 as shown in Table 2 correspond to those of the circuit as shown in FIG. 1*c*), the switching condition 4 correspond to P being short-circuited to R.

Instead of solenoid valve piloting, requiring the use of various solenoid valves, the same circuit arrangements may be achieved by a single pilot element configured as 4/3- way valve.

Referring now to FIGS. 4 to 8 there is illustrated the construction of one such pilot element which will now be described. The pilot element 10 comprises a housing 12 in which two juxtaposed control chambers 20, 30 are configured isolated from each other, of which only one is evident from FIG. 4. Opening into each control chamber is a working port and two pressure ports, the working port being identified by A or B and the pressure ports by P and R, respectively. Two of the ports in each control chamber 20 or 30 are provided with a sealing seat 21, 22 and 31, 32, respectively. Cooperating with the sealing seats 21, 22 and 31, 32 is a switching element identified in general by the reference numeral 14. The switching element 14 is movable from a resting position into a first and second position by acting on an actuator protuberance 15. In all, three positions of the switching element 14 are thus possible. For actuating the switching element 14 an actuating member 16 is provided (see more particularly FIG. 6) configured, for example, as a solenoid drive having a polarized drive element, the permanent magnet of which in the non-energized condition of a solenoid causes a center position of the actuator protuberance 15 and in the energized condition shifts the actuating arm in the direction of either arrow 1 or arrow 2 depending on the direction of the current.

Figure 6:
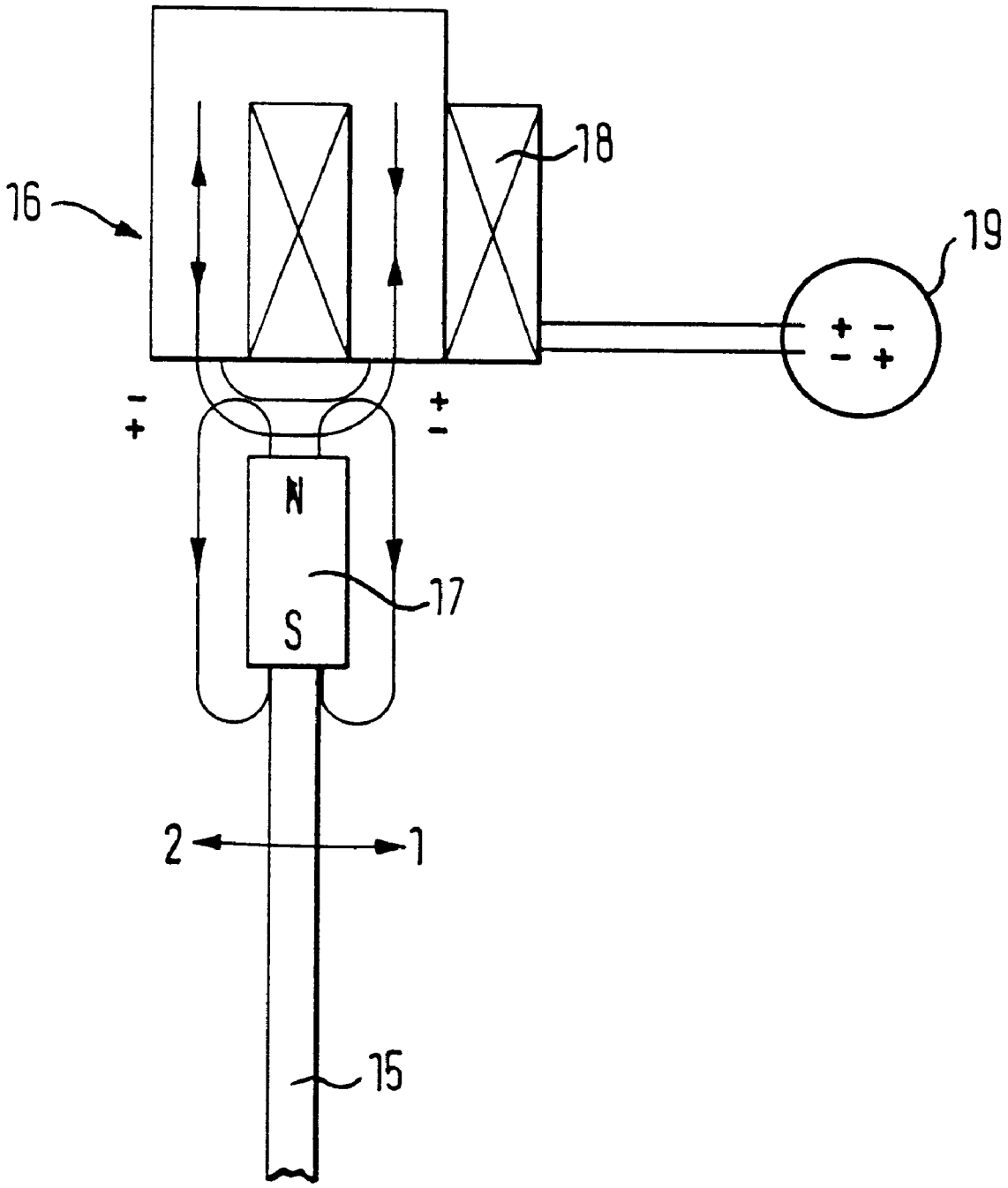
FIG. 6 is a schematic illustration of an actuating member as may be used with the pilot element as shown in FIG. 5.

Referring now to FIG. 6 there are illustrated the two positions 1 and 2 of a magnet 17 applied to the actuator protuberance 15. The solenoid of the actuating member is identified by the reference numeral 18 and the switchable voltage source is identified in FIG. 6 by the reference numeral 19.

The basic construction of the switching element 14 comprising a core 11 and an elastomer 13 surrounding the latter, as well as the mounting arrangement of the switching element in the housing 12 is known in principle from U.S. Pat. No. 5,711,346 which is incorporated herein by reference. The detailed construction of the switching element can be derived from this patent.

Figure 7:
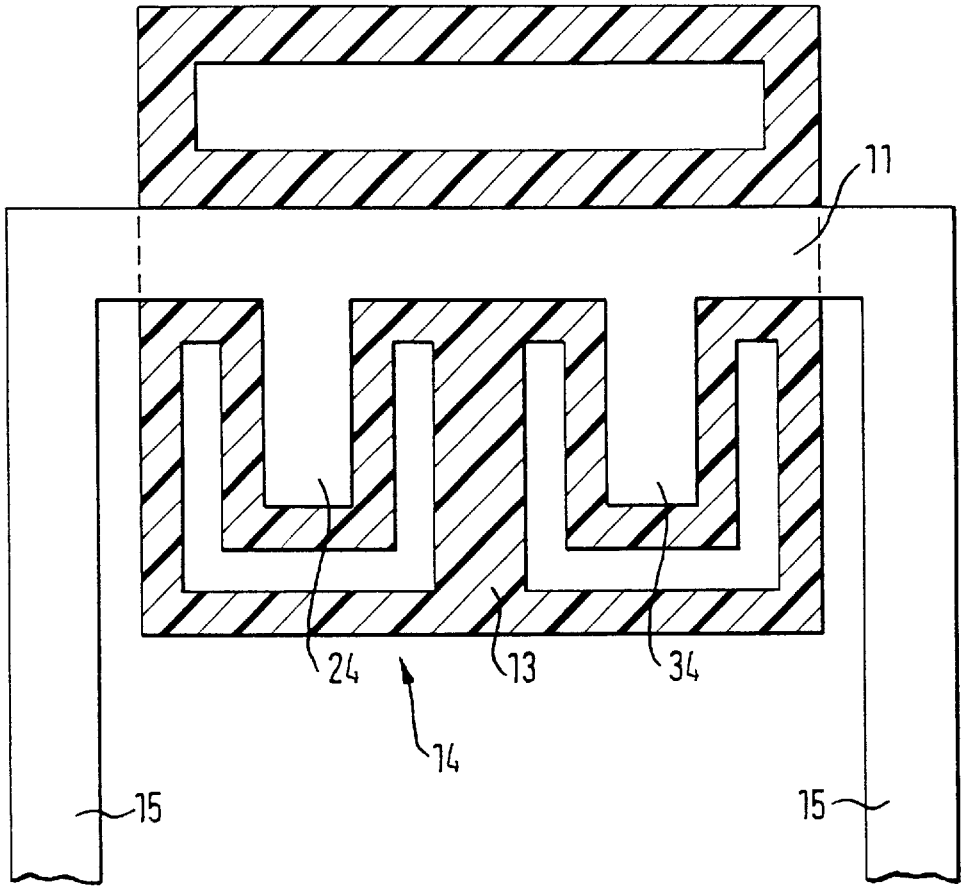
FIG. 7 is a schematic plan view of a switching element as may be used with the pilot element as shown in FIG. 5.
Figure 8:
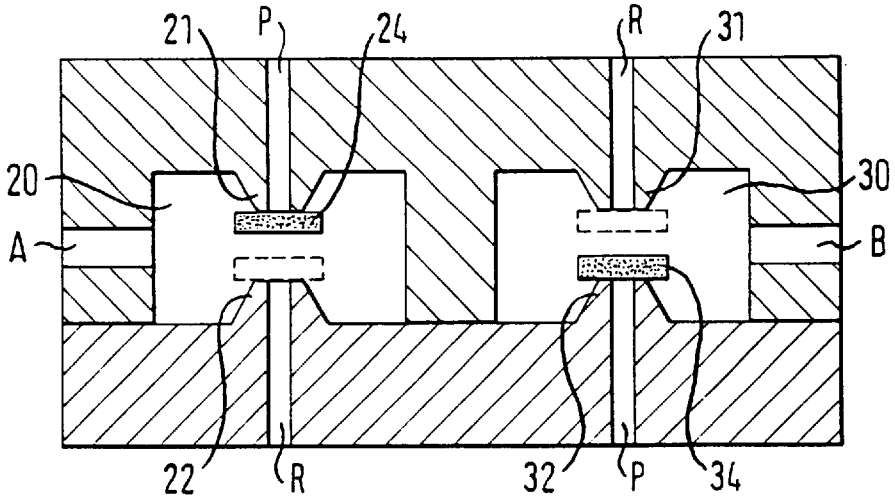
FIG. 8 is a schematic cross-section through the two control chambers of the pilot element as shown in FIG. 5.

Referring now to FIGS. 7 and 8 the functioning of the pilot element will now be described in detail. The switching element 14 protrudes into each control chamber 20, 30 with a sealing part 24 and 34, respectively. The two sealing parts 24, 34 are fixedly connected to the actuator protuberance 15 and are moved simultaneously with the actuator protuberance. The two sealing parts 24, 30 are arranged at different levels, i.e. mutually staggered, whereas each of the sealing seats 21, 31 arranged on the upper side of the control chambers 20, 30 and the sealing seats 22, 23 arranged on the underside of the control chambers is at the same level.

When with reference to the resting position as shown in FIG. 8 the sealing parts 24, 34 are urged upwards there is no change in the switching condition as regards control chamber 20 due to the sealing part 24 deforming elastically and continuing to be in contact with the sealing seat 21, whilst the sealing part 34 in the control chamber 30 is lifted from the sealing seat 32 and pressed against the sealing seat 31, whereas when the sealing parts 24, 34 are urged downwards there is no change in the switching condition as regards control chamber 30 whilst the sealing part 24 in the control chamber 20 is lifted from the sealing seat 21 and pressed against the sealing seat 22. It will readily be appreciated that differing switching conditions are achievable by suitably swapping the circuiting of the ports. It is also possible to use sealing parts which instead of being mutually staggered are arranged in a single plane when simultaneous use is made of staggered sealing parts 21 and 31 or 22 and 32.

Figure 9:
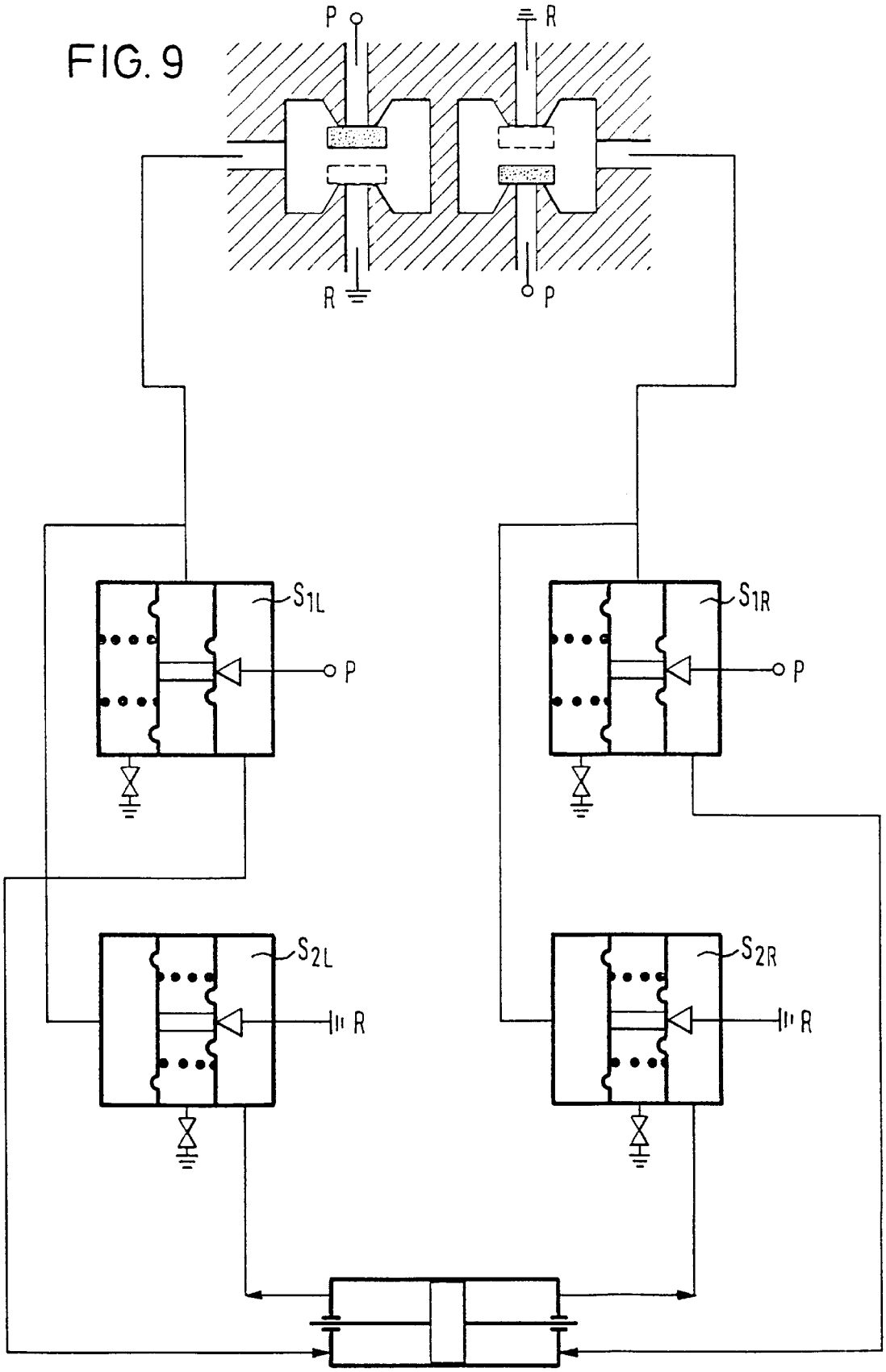
FIG. 9 is a schematic illustration of the first circuit arrangement for an actuator including a pilot element in accordance with a first embodiment.

Referring now to FIG. 9 there is illustrated a circuit based on the circuit as shown in FIG. 2 using the pilot element as known from FIGS. 4 to 8 instead of the solenoid valve M as shown in FIG. 2. This circuit as shown corresponds to the example as shown in FIG. 1*a*). In the starting position as shown in FIG. 9 in which the two pressure ports P of the pilot element are closed, a float circuit is achieved in which the two working chambers of the actuator are connected to R.

Figure 10:
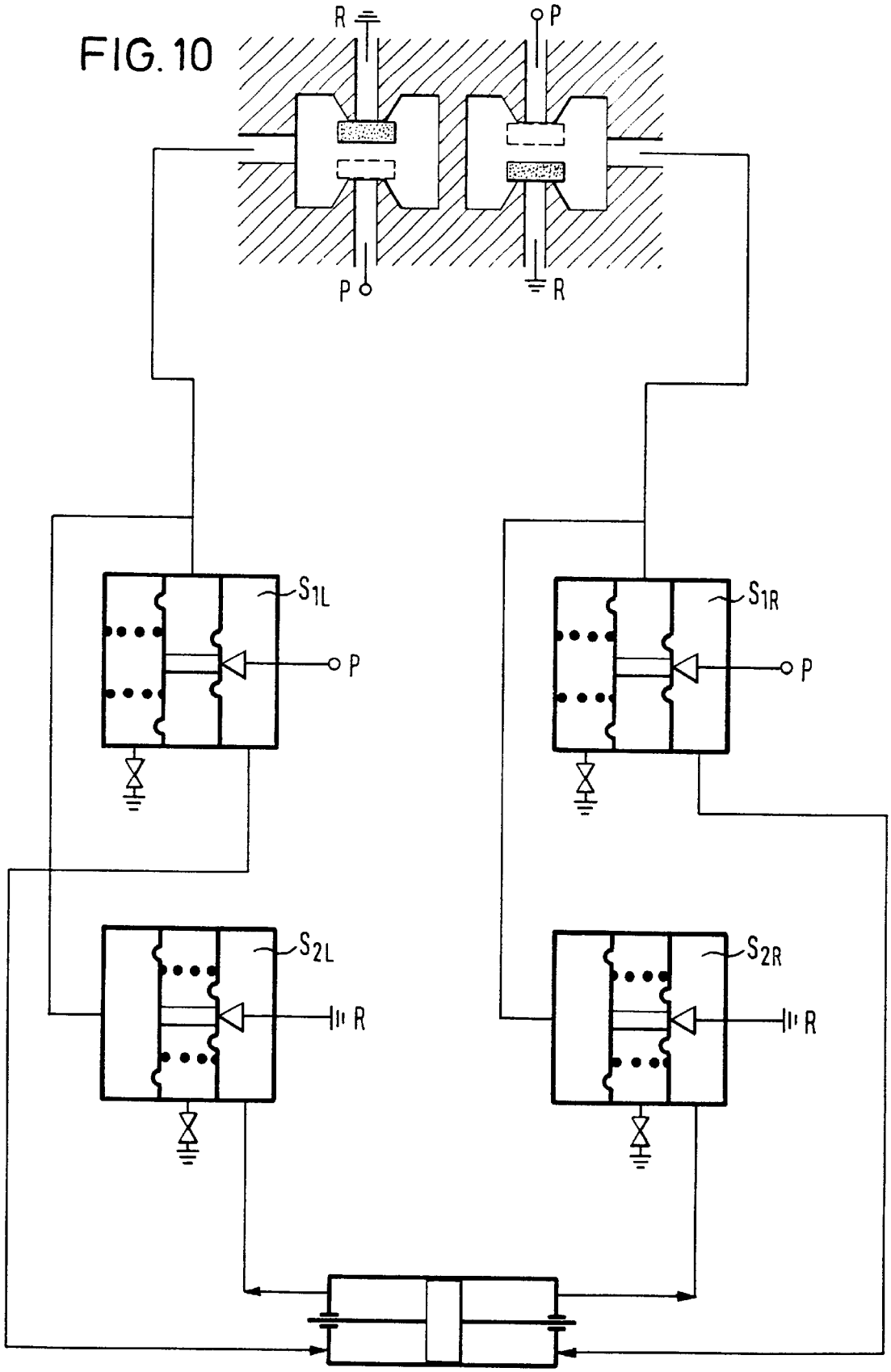
FIG. 10 is a schematic illustration of the first circuit arrangement for an actuator including a pilot element in accordance with a second embodiment.

Referring now to FIG. 10 there is illustrated a similar circuit, except that in this case the circuiting of the ports of the pilot element has been changed. This circuit as achieved corresponds to the example as shown in FIG. 1*b*). In the starting position of the valve element, in which the two return ports R are closed, the piston of the actuator is blocked by pressurization at P on both sides.

Figure 11:
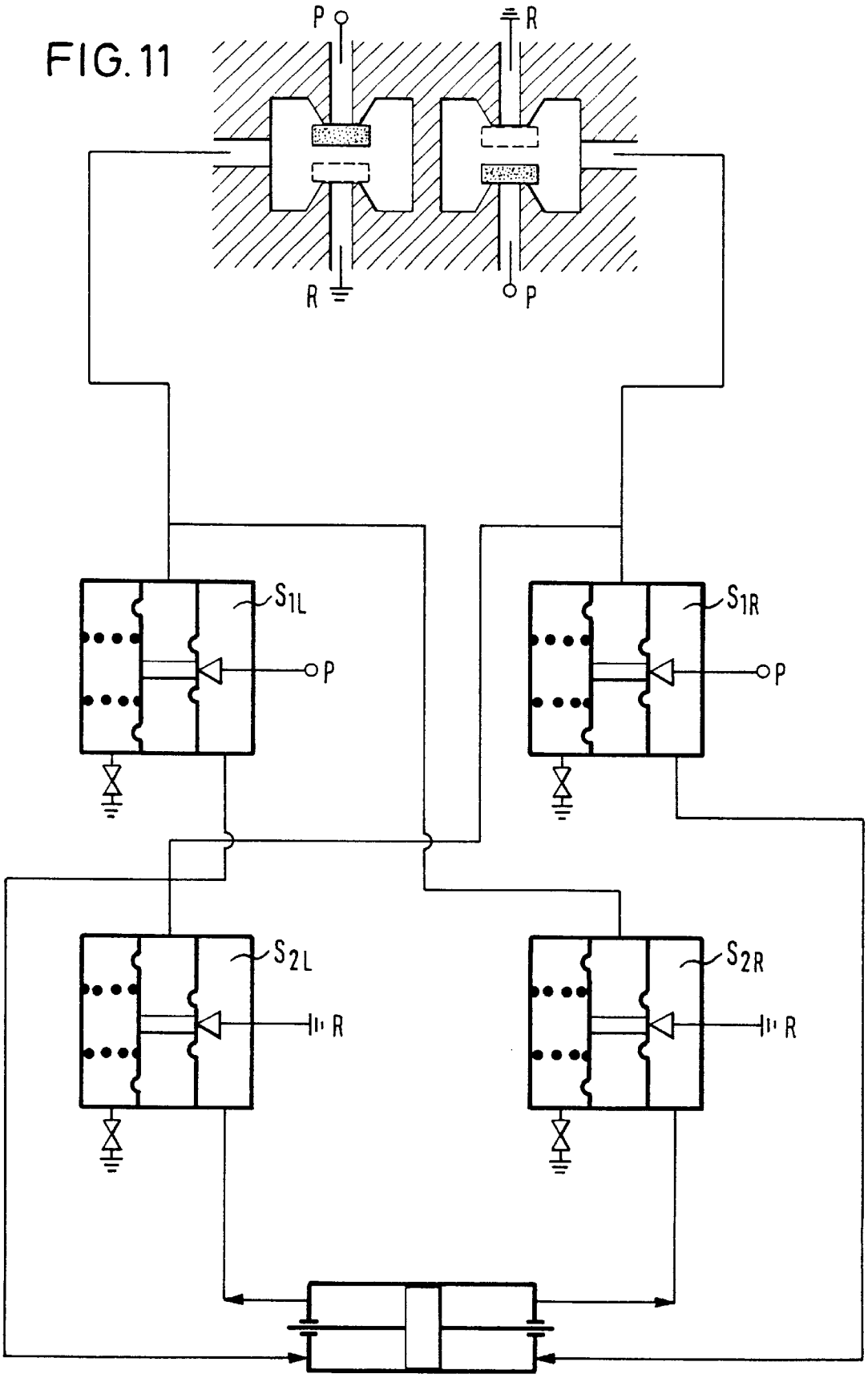
FIG. 11 is a schematic illustration of the second circuit arrangement for an actuator including a pilot element in accordance with a first embodiment.

Referring now to FIG. 11 it is evident that the pilot element as known from FIG. 9 is combined with the circuit of the switching valves known from FIG. 3. The result is the circuit as known from FIG. 1*c*), whereby in the resting position as shown in FIG. 11 in which the two pressure ports P of the pilot element are blocked, both the two working chambers of the actuator and the ports P, R are closed.

Figure 13:
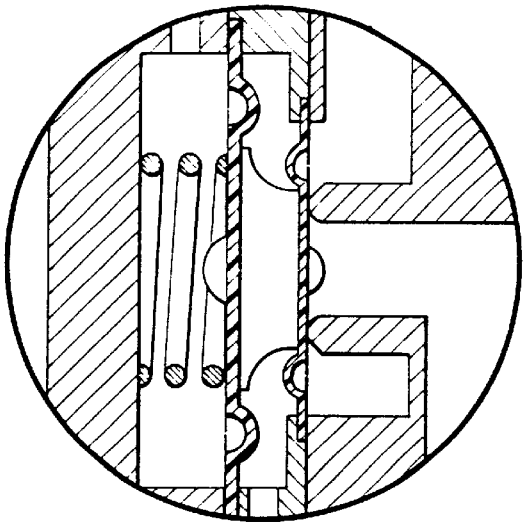
FIG. 13 is a detail on a magnified scale of the valve island as shown in FIG. 12.
Figure 12:
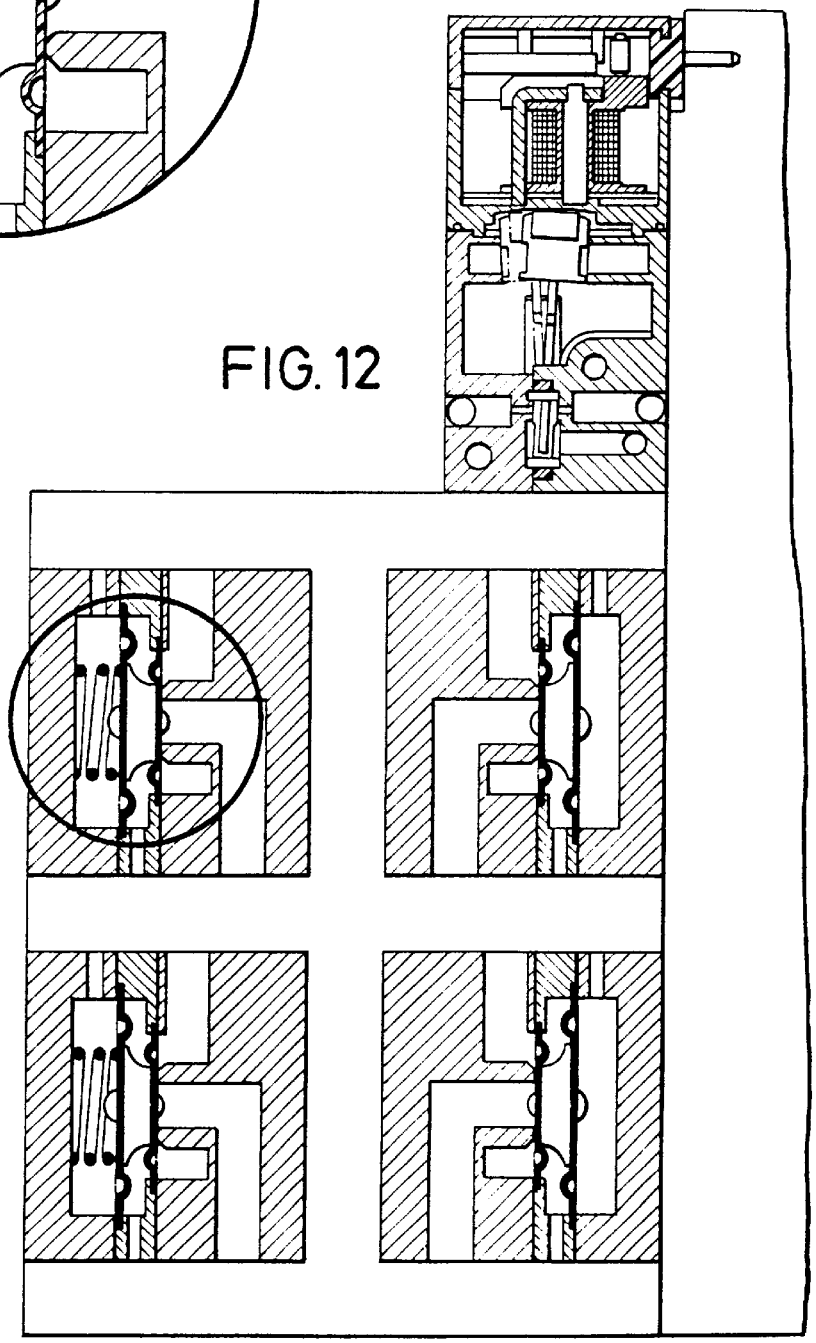
FIG. 12 is a section through a valve island including a pilot element.

Finally, in FIGS. 12 and 13 there is illustrated a valve block achieved by combining the switching valves S with a pilot element as shown in FIGS. 4 to 8. Clearly evident is the particularly compact construction which is established since only one pilot solenoid is needed, thus making it particularly suitably for use in an in-line valve system with a continuous pneumatic supply terminal and an electric connection terminal for power supply and, respectively, digital pulse driving of the solenoids as is known in field bus technique. In addition to this, a high throughput establishes since only few flow bypasses are needed. Since all pilot components and the switching valves are configured with no friction the arrangement is particularly suitably for systems sealed-for-life (no basic lubrication with dry compressed air) involving low wear and long life.

What is claimed is:

1. A module comprising a pilot valve and four switching valves connected thereto, said pilot valve being a 4/3- way valve, wherein said pilot valve comprises a housing in which two control chambers are formed which are isolated from each other and each comprise a working port well as two pressure ports, two of said ports being provided with a sealing seat each, said pilot valve further comprising a switching element which is movably mounted in said housing and has a sealing part arranged in each of said control chambers, said sealing part cooperating with said sealing seats such that these are opened or closed, said pilot valve further comprising an actuating member for said switching element, said actuating member being able to bring said switching element into three positions.

2. The module of claim 1, wherein said sealing seats of one of said control chambers are disposed opposite each other on the one and the other side of said control chamber and said sealing part arranged in said one control chamber being in contact with either the one or the other of said sealing seats.

3. The module of claim 2, wherein said sealing parts arranged in said two control chambers extend in differing planes, one of said sealing parts, when in a resting position, contacting one of said sealing seats disposed on the one side of the corresponding of said control chambers whilst the other of said sealing parts contacting the other of said sealing seats arranged at the other side of the other of said control chambers.

4. The module of claim 1, wherein said switching valves are diaphragm valves.

* * * * *